United States Patent [19]

Lex

[11] 4,277,861

[45] Jul. 14, 1981

[54] CLEANING DEVICE FOR VENETIAN BLINDS

[76] Inventor: Franz Lex, Annenstrasse 6, A 8020 Graz, Austria

[21] Appl. No.: 70,316

[22] Filed: Aug. 27, 1979

[30] Foreign Application Priority Data

Sep. 4, 1978 [AT] Austria ..... 636578

[51] Int. Cl.[3] ..... A47L 4/00

[52] U.S. Cl. ..... 15/102; 15/22 R; 15/97 R

[58] Field of Search ..... 15/22 R, 22 A, 22 C, 15/23, 24, 28, 77, 97 R, 100, 102, 210 A

[56] References Cited

U.S. PATENT DOCUMENTS

| | | | |
|---|---|---|---|
| 2,852,790 | 9/1958 | Bowman | 15/77 |
| 2,975,448 | 3/1961 | Glaser | 15/22 R |
| 3,447,177 | 6/1969 | Williams et al. | 15/23 |
| 3,892,004 | 7/1975 | Downes | 15/24 |
| 3,995,343 | 12/1976 | Horner | 15/77 X |

FOREIGN PATENT DOCUMENTS

| | | | |
|---|---|---|---|
| 956984 | 9/1949 | France | 15/22 C |

*Primary Examiner*—Edward L. Roberts
*Attorney, Agent, or Firm*—Kurt Kelman

[57] ABSTRACT

A cleaning device for a Venetian blind element comprises a pair of cooperating cleaning bodies mounted on a hand-held housing and having cleaning parts for holding the element therebetween in a cleaning position of the cleaning bodies. One of the cleaning bodies is manually movable away from the other cleaning body for spacing the cleaning parts apart, and a driving system is mounted in the housing for transmitting a vibratory cleaning motion to one or both cleaning bodies.

10 Claims, 3 Drawing Figures

CLEANING DEVICE FOR VENETIAN BLINDS

The invention relates to a cleaning device for Venetian blinds, preferably formed as a hand-held device, comprising a housing enclosing an electrically-operated driving system for at least two cleaning bodies contacting respective surfaces of a Venetian blind element. The cleaning bodies are preferably replaceably arranged in housing.

A cleaning device of this type has been described, for example, in Published German Patent Application Ser. No. 2,634,556. This device has two rotary brushes positioned parallel to each other in a housing and driven by a drive motor, the ends of the brushes being in contact or overlapping with each other in a generatrix, and the brushes being largely surrounded by a cover.

The substantial disadvantage of this construction is the fact that the rotatingly driven rotary brushes spin off the dirt removed from the Venetian blinds together with the cleaning agent tangentially so that they must be covered as fully as possible and must be equipped with a suction device to avoid dirtying the work place. This necessary covering hinders the insertion of the cleaning bodies between the Venetian blind elements and makes their cleaning difficult at those locations where the individual Venetian blind elements are held together by vertically running connecting cords while also making it difficult to reach the ends of the Venetian blinds for cleaning, for instance when extending into wall recesses. The required connection to a suction device, on the other hand, considerably interferes with the handling. Furthermore, circumferentially contacting rotary cleaning brushes cannot be inserted between curved and thin Venetian blind elements without danger of damaging them.

It is the object of the invention to obviate the disadvantages of the conventional devices and to provide a cleaning device of the first-mentioned type which makes possible the cleaning of Venetian blinds without hindrance and damage thereto, and assures cleaning along the entire length thereof. One purpose thereof is the simplication of the drive.

This is accomplished according to the invention by connecting the cleaning bodies to a drive system which transmits a vibratory or oscillatory cleaning motion to the Venetian blind element(s) to be cleaned. This makes it possible to form the cleaning bodies without a covering which interferes with the cleaning operation since the oscillatory cleaning motion largely prevents any dirtying of the work place. This drive furthermore enables the cleaning bodies to be formed in an advantageous manner in a flat cross section, i.e. with a small structural height, and also to be provided with various materials adapted to cleaning, such as, for example, foams, felt, synthetic resin webs, fur skins, brushes, etc.

In a further embodiment according to the invention, the drive system is driven electromagnetically.

In another embodiment according to the invention, the drive system is driven by an electric motor.

The vibratory or oscillatory movement of the cleaning bodies may be effected perpendicularly as well as parallel to the surface of the Venetian blind element to be cleaned. It may also combine both movements to enhance the effectiveness of the cleaning; nor do circular or arcuate or like oscillatory movements in any way diminish the cleaning effect—if they are desired to simplify the drive system. An oppositely directed cleaning motion of the two cleaning bodies may also be applied.

A simplification of the drive system and its sealing as compared to the conventional construction may be obtained in accordance with a further embodiment of the invention if it is so structured that only one drive component is provided for transmitting the cleaning movement to both cleaning bodies. Preferably, only that cleaning body is driven directly which has to clean the upper surface of the Venetian blind. Since the two cleaning bodies are in contact on both sides with the cleaning faces outside the Venetian blind element, the oscillatory cleaning motion is transmitted to the lower cleaning body by friction. The latter is preferably mounted with some play. If desired, the two cleaning bodies may also be mechanically connected outside the housing, for example by a bolt.

According to a preferred embodiment of the cleaning device with an electromagnetic drive, the driving system is constituted by a drive part comprising a two-armed lever pivotally mounted on the housing, one lever arm carrying the armature of a solenoid and the other lever arm carrying the cleaning body.

According to a preferred embodiment of the cleaning device with an electric drive motor, the driving system is constituted by a cam driven by the drive motor and a drive part pivotally mounted on the housing, the drive part receiving or forming the cleaning body, the cam and drive part being preferably so arranged with respect to each other that the cam engages a slit-shaped recess in the drive part. The cam may be arraned directly on the shaft of the drive motor or on a spur gear driven thereby and having, if desired, an oblique or sinuous surface to obtain an additional cleaning motion. In this case, it is advantageous to form the cam on the driven spur gear in the shape of an eccentric recess engaged by the pivotally mounted drive part. To enable a Venetian blind element to be inserted between the two cleaning bodies without difficulty, a further, particularly advantageous embodiment of the device according to the invention provides for arranging especially The one of cleaning bodies for downward movement or downward pivoting, preferably mounted on the housing of the device and being operable by a lever. This lever may be arranged within the range of the handle of the device on the housing or, in a particularly preferred manner, it may be constituted by an extension of the lower cleaning body and integral therewith.

To obtain a uniform contact pressure of both cleaning bodies desirable for cleaning, the two cleaning bodies may be biased against each other by a spring according to a further embodiment of the invention. Another very advantageous embodiment of the invention provides cleaning bodies of an essentially rectangular cross section and conforming to the curvature of the Venetian blind.

In a further advantageous embodiment of the invention, preferably the upper cleaning body defines a channel and a receptacle containing a cleaning medium may be arranged on the device and be connected to the channel. In some instances, mounting a small catch basin for dripping dirty water in the range of the lower cleaning body may be of advantage. A hollow handle may be used for this purpose. Commercially used devices may also be equipped with a suction means or may be constructed for connection to such means.

The invention is described in more detail in conjunction with two embodiments:

Figure 1:
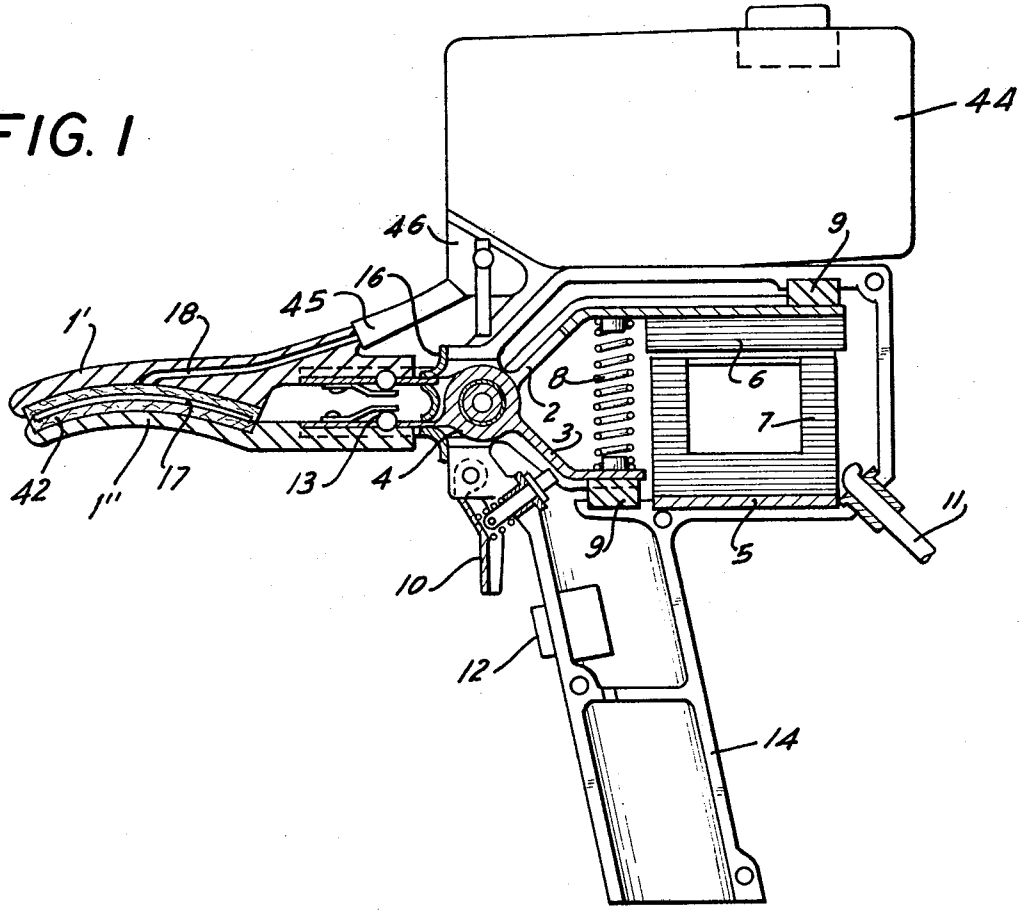
FIG. 1 shows a longitudinal section of a device according to the invention with an electromagnetic drive and FIG. 2 shows a longitudinal section of such a device with an electric drive motor.

The embodiment of a cleaning device according to the invention illustrated in FIG. 1 is a hand-guided cleaning device for Venetian blinds with an electromagnetic drive, wherein housing 5 has hand grip 14 and consists of two parts joined in the plane of section and held together by screws. Magnetic core 7 of a solenoid is fixedly mounted in housing 5 and receives its current supply through power cord 11 and is energized by operation of circuit breaker 12. One arm of drive lever 2 carries magnetic armature 6 and is fork-shaped and the fulcrum of this lever is pivotally mounted on bearing bolt 4 affixed to housing 5. The other arm of drive lever 2 extends at an angle to the one lever arm and is upwardly bent in a U-shape to form a guide channel, cleaning body 1' being replaceably inserted therein and held in position by retaining device 13, which is illustrated as a leaf spring attached to the other lever arm and depressing a bolt or ball through a bore in the other lever arm into a matching groove in the cleaning body. Damping element 9 affixed to housing 5 is designed to prevent transmission of vibration thereto. Carrier element 3 for receiving cleaning body 1'' is also mounted pivotally on bearing bolt 4 between the fork-shaped arm of drive lever 2 and the drive arm of carrier element 3 extends at an angle, being biased against housing 5 by spring 8 through damping element 9. Spring 8 is so arranged that it functions to bias magnetic armature 6 away from core 7 and also provides the contact pressure of cleaning bodies 1', 1'' against each other. The other arm of carrier element 3 also is U-shaped to form a guide channel for replaceably receiving cleaning body 1'' which is held therein by the same type of retaining device 13 as described hereinabove. Carrier element 3 may be pivoted downwardly for opening by lever 10 to facilitate the insertion of the cleaning bodies between Venetian blind elements. Cleaning body 1' defines channel 18 connected by connecting conduit 45 and check valve 46 with container 44 for a cleaning medium. Sealing element 16 seals the drive part from the interior of housing 5. Cleaning parts 42 are preferably bonded to the receiving body but may also be replaceably inserted therein. In this embodiment, the drive for the cleaning body is so constructed that it imparts a vibratory cleaning motion perpendicularly to the surface of the Venetian blind to be cleaned. If the solenoid is displaced in the housing by 90° so that bearing bolt 4 is arranged vertically, a minor modification of the device produces an oscillatory, i.e. a reciprocatory, cleaning motion parallel to the surface of the Venetian blind. The drive may also be provided for both cleaning bodies by a double-acting magnet.

Figure 2:
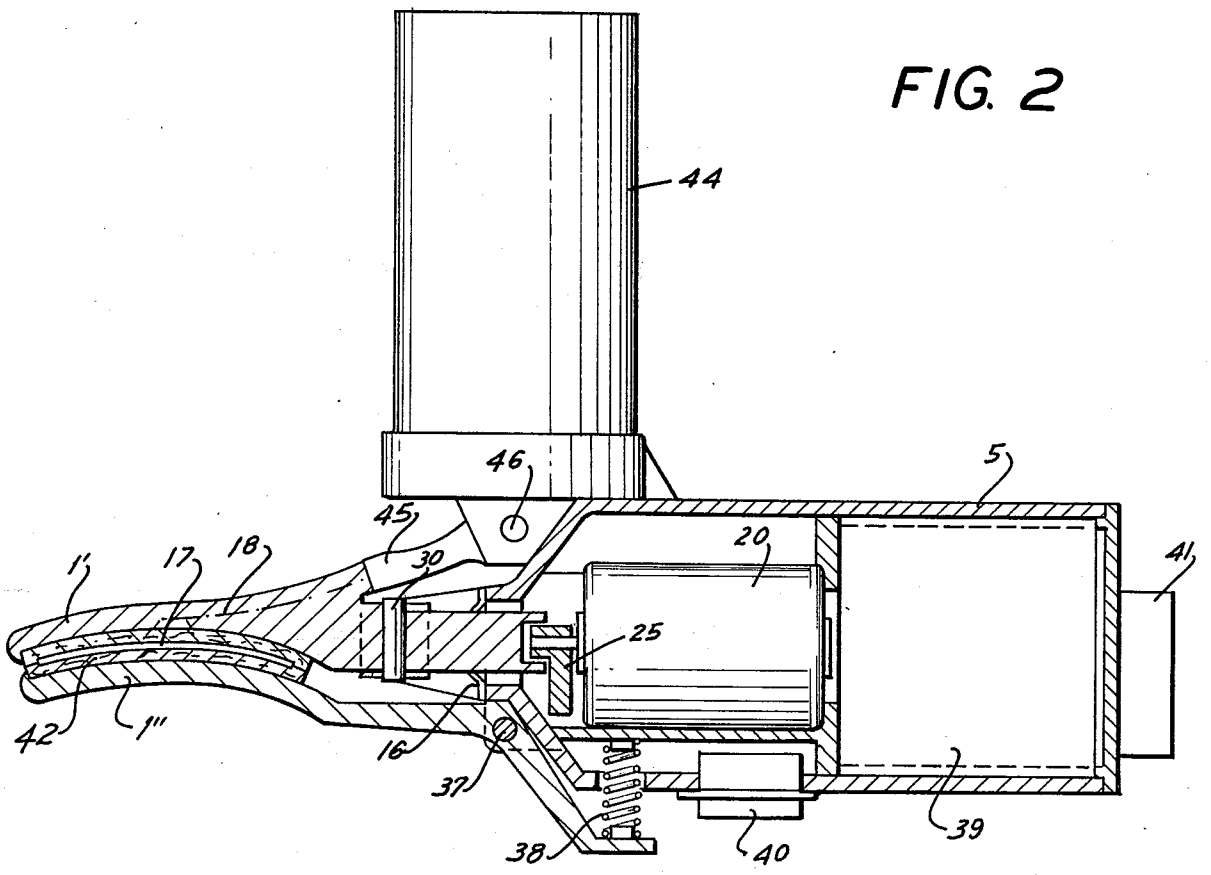
Figure 3:
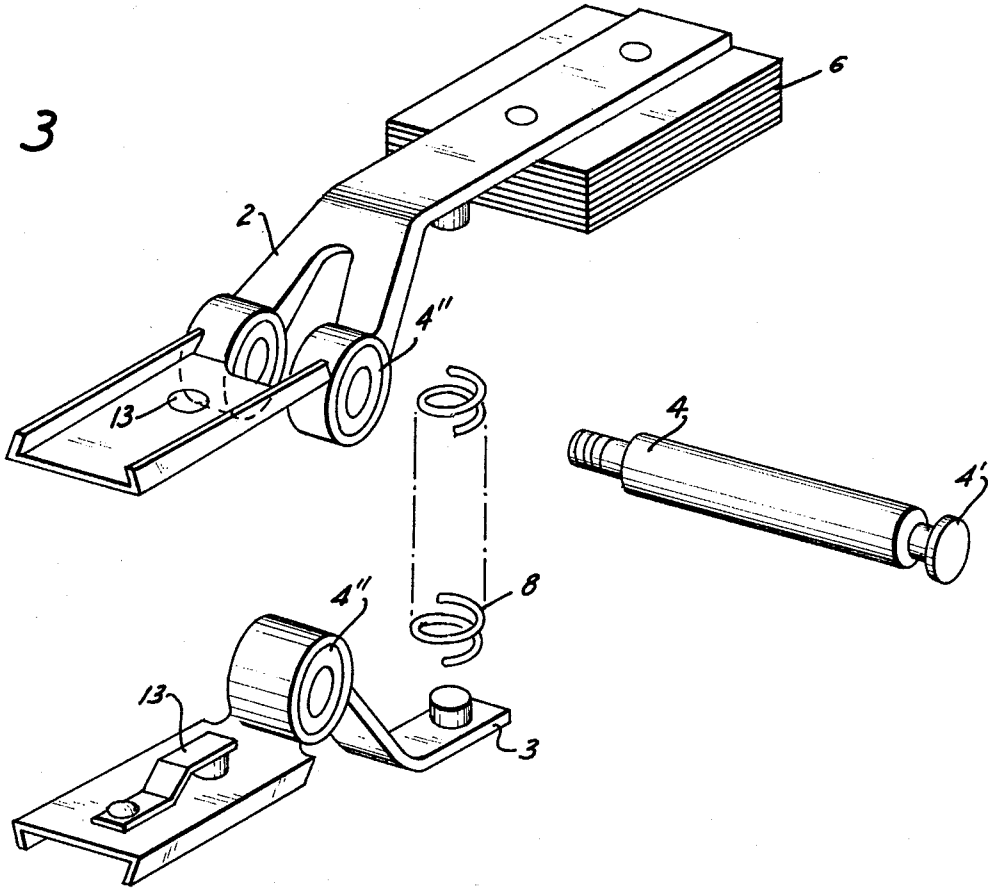
FIG. 3 shows an exploded view of the cleaning means support levers of the embodiment of FIG. 1.

The embodiment of the invention illustrated in FIG. 2 shows a construction of the cleaning device for Venetian blinds with an electro-motor drive. Electric motor 20 is fixedly mounted in housing 5, which is integral except for the rear side and is partially shaped as a handle, cam 25 being keyed to the motor shaft and carrying a flywheel mass. The cam engages in a slit-shaped recess defined in cleaning body 1' which is rotatably journaled on bolt 30 in housing 5 whereby the cleaning body is oscillated in a lateral reciprocatory motion. Cleaning body 1'' is pivotally mounted on bolt 37 on housing 5 and is biased against cleaning body 1' by compression spring 38. If desired, the bias of compression spring 38 may be adjustable. Again, cleaning bodies 1' and 1'' are equipped with cleaning part 42 which may be comprised of various materials. Cleaning body 1' defines a channel 18 connected by connecting conduit 45 and check valve 46 to cleaning medium container 44. Switch 40 for drive motor 20 is mounted on the device for actuating and stopping the motor. Drive motor 20 may be operated by chargeable batteries 39 whose charging plug is designated 41. Of course, the drive motor may also be operated directly by current from an available electric supply network or a low voltage net.

Similar objects, like window sills or heating elements, for example, may also be cleaned with the cleaning device of the invention.

I claim:

1. A cleaning device for a transversely curved Venetian blind element, which comprises (a) a housing, (b) a pair of cooperating cleaning bodies mounted on the housing, each cleaning body having a conformingly curved cleaning part for holding the Venetian blind element therebetween in a cleaning position of the cleaning bodies, (c) means for manually moving one of the cleaning bodies away from the other cleaning body for spacing the cleaning parts apart, and (d) a driving system mounted in the housing for transmitting a vibratory cleaning motion to at least one of the cleaning bodies.

2. The cleaning device of claim 1, shaped to be hand-held.

3. The cleaning device of claim 1, wherein the driving system is arranged to transmit the cleaning motion to both cleaning bodies.

4. The cleaning device of claim 1, wherein the one cleaning body is a two-armed lever pivotally mounted on the housing, the moving means engaging one of the lever arms for pivoting the one cleaning body away from the other cleaning body, and the other lever arm carrying the cleaning part.

5. The cleaning device of claim 4, further comprising spring means for biasing the one cleaning body towards the other cleaning body.

6. The cleaning device of claim 1, further comprising a container for a cleaning medium mounted on the housing, at least one of the cleaning bodies defining a conduit in communication with the container for delivering the cleaning medium from the container to the cleaning part.

7. The cleaning device of claim 1, wherein the one cleaning body is pivotally mounted on the housing and the driving system is arranged to transmit the cleaning motion only to the other cleaning body.

8. The cleaning device of claim 1, wherein the driving system comprises a solenoid including a core fixedly mounted in the housing and an armature, the solenoid being arranged to transmit the cleaning motion to both cleaning bodies, each cleaning body includes a two-armed lever pivotal about a common fulcrum, one of the arms of the levers extending into the housing and forming a pincer and the other lever arms projecting from the housing and carrying the cleaning parts, the one lever arm of the other cleaning body carrying the armature, and further comprising a bolt mounted in the housing and supporting the common fulcrum of the two levers, and a spring means mounted between the arms of the levers forming the pincer for biasing the other lever arms towards each other.

9. The cleaning device of claim 8, wherein the cleaning parts are removably mounted on the other lever arms.

10. The cleaning device of claim 1, wherein the driving system comprises an electric motor mounted in the housing and a cam driven by the motor, each cleaning body includes a two-armed lever, one of the lever arms of the other cleaning body to which the cleaning motion is transmitted extending into the housing and defining a slot receiving the cam, and the other lever arm of the other cleaning body carrying the cleaning part, one of the lever arms of the one cleaning body movable away from the other cleaning body constituting the moving means and the other lever arm of the one cleaning body carrying the cleaning part, and further comprising a respective bolt pivotally supporting each two-armed lever on the housing, and a spring means engaging the one lever arm constituting the moving means and biasing the other lever arm of the one cleaning body towards the other lever arm of the other cleaning body.

* * * * *